US012723797B2

(12) United States Patent
Wang et al.

(10) Patent No.: US 12,723,797 B2
(45) Date of Patent: Sep. 1, 2026

(54) AGING DEVICE AND REFRIGERATING AND FREEZING APPARATUS

(71) Applicants: QINGDAO HAIER REFRIGERATOR CO., LTD., Qingdao (CN); HAIER SMART HOME CO., LTD., Qingdao (CN)

(72) Inventors: Chunli Wang, Qingdao (CN); Hao Zhang, Qingdao (CN); Tong Chen, Qingdao (CN); Zhanpeng Cui, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 106 days.

(21) Appl. No.: 18/726,064

(22) PCT Filed: Dec. 23, 2022

(86) PCT No.: PCT/CN2022/141205
§ 371 (c)(1),
(2) Date: Jul. 1, 2024

(87) PCT Pub. No.: WO2023/130981
PCT Pub. Date: Jul. 13, 2023

(65) Prior Publication Data

US 2025/0137709 A1 May 1, 2025

(30) Foreign Application Priority Data

Jan. 5, 2022 (CN) ..... 202210006723.7

(51) Int. Cl.
*F25D 17/06* (2006.01)

(52) U.S. Cl.
CPC ..... *F25D 17/065* (2013.01)

(58) Field of Classification Search
CPC .... F25D 17/065; F25D 17/061; F25D 25/025; F25D 25/028; F25D 17/062
See application file for complete search history.

(56) References Cited

U.S. PATENT DOCUMENTS

2003/0115892 A1* 6/2003 Fu ..... F25D 25/021 62/3.6
2010/0154460 A1* 6/2010 Kim ..... F25D 17/065 62/449

(Continued)

FOREIGN PATENT DOCUMENTS

CN 204460886 U 7/2015
CN 211575653 U 9/2020

(Continued)

*Primary Examiner* — David J Teitelbaum
(74) *Attorney, Agent, or Firm* — MUNCY, GEISSLER, OLDS & LOWE, P.C.

(57) ABSTRACT

An aging device for refrigerating and freezing apparatus includes a aging drawer configured to be retractably provided in a cabinet of the refrigerating and freezing apparatus, the interior of the aging drawer is defined a aging chamber for containing the items to be aged, a rear wall of the aging drawer being provided with a return air inlet and at least one air outlet; a circulation fan, a plurality of seal mounting holes being arranged at intervals on the peripheral side of each airflow outlet of the circulating fan; and at least one sealing ring, each of sealing ring is annularly arranged around the periphery of a corresponding airflow outlet, a plurality of seal mounting structures are spaced on one side of each sealing ring and are configured to lock and fit with the seal mounting holes.

18 Claims, 3 Drawing Sheets

(56) References Cited

U.S. PATENT DOCUMENTS

| | | | | |
|---|---|---|---|---|
| 2012/0304667 | A1* | 12/2012 | Shin | F25B 25/00 62/3.6 |
| 2015/0184918 | A1* | 7/2015 | Klingshirn | F25D 17/08 62/414 |
| 2020/0068924 | A1* | 3/2020 | Zhu | F25D 17/045 |

FOREIGN PATENT DOCUMENTS

| | | | | |
|---|---|---|---|---|
| CN | 113662149 | A | 11/2021 | |
| CN | 214582007 | U | 11/2021 | |
| CN | 214582008 | U | 11/2021 | |
| CN | 214903625 | U | 11/2021 | |
| CN | 113758100 | A | 12/2021 | |
| CN | 217446560 | U | 9/2022 | |
| CN | 116255788 | A | 6/2023 | |
| EP | 2789937 | A1 * | 10/2014 | F25D 17/045 |
| EP | 3346210 | A2 * | 7/2018 | F25D 17/06 |
| EP | 4443088 | A1 | 10/2024 | |
| KR | 100572872 | B1 | 4/2006 | |

* cited by examiner

AGING DEVICE AND REFRIGERATING AND FREEZING APPARATUS

This application claims priorities of the Chinese patent application No. 202210006723.7 filed on Jan. 5, 2022, which are incorporated herein by reference in their entireties.

TECHNICAL FIELD

The present application relates to refrigerating and freezing technology, in particular to an aging device for refrigerating and freezing apparatus and a refrigerating and freezing apparatus.

BACKGROUND

In recent years, with consumers' continuous pursuit of food flavor, aged food has become popular due to its prominent flavor. The so-called aged food refers to meat that has been placed in an environment with certain temperature, humidity, and airspeed after acid discharge, where it undergoes slow natural fermentation. During this process, proteins continually break down into various amino acids, and fats decompose to produce a rich cheese flavor, ultimately generating a deeper flavor profile, enhancing the meat's tenderness, flavor, and juiciness. Therefore, the aging device needs to be designed with an internal circulation air duct to control the airspeed within the aging chamber, ensuring the aging effect.

However, existing aging devices lack a design for sealing the internal circulation air duct. The various joints of the internal circulation air duct are not tightly sealed, which can easily result in air leakage, leading to issues such as low airspeed and uneven airflow circulation in the aging chamber during the aging process. This further causes low aging efficiency or even aging failure due to the slow evaporation of moisture from the surface of the items to be aged.

Reference to any prior art in the specification is not, and should not be taken as, an acknowledgment or any form of suggestion that this prior art forms part of the common general knowledge in US or any other jurisdiction or that this prior art could reasonably be expected to be understood and regarded as relevant by a person skilled in the art.

SUMMARY

One objective of the first aspect of the present application is to overcome at least one defect of the prior art by providing an aging device for refrigerating and freezing apparatus that prevents air leakage in the internal circulation air duct.

A further objective of the first aspect of the present application is to optimize and define the structure of a sealing ring provided in the aging device, so that the air outlet of the aging drawer can be easily and reliably sealed with the airflow outlet of the circulation fan, thereby further improving the sealing performance.

The second aspect of the present application aims to provide a refrigerating and freezing apparatus provided with the aforementioned aging device.

According to the first aspect of the present application, an aging device for refrigerating and freezing apparatus is provided, which is used for aging items to be aged therein, wherein the aging device comprising:

an aging drawer configured to be retractably provided in a cabinet of the refrigerating and freezing apparatus, the interior of the aging drawer is defined an aging chamber for containing the items to be aged, a rear wall of the aging drawer being provided with a return air inlet and at least one air outlet;

a circulation fan is provided with at least one airflow outlet and is configured such that, when the aging drawer is pushed into the cabinet, each airflow outlet faces one of the at least one air outlet, directing airflow through the at least one air outlet into the aging chamber and then out through the return air inlet.

Furthermore, wherein a plurality of seal mounting holes are spaced around a periphery of each airflow outlet; the aging device further comprising:

at least one sealing ring, each sealing ring is annularly arranged around the periphery of a corresponding airflow outlet and is configured to fit against the corresponding air outlet when the aging drawer is pushed into the cabinet, a plurality of seal mounting structures are spaced on one side of each sealing ring and are configured to lock and fit with the seal mounting holes.

Furthermore, wherein the seal mounting structures comprise a plurality of seal mounting ribs and a plurality of seal positioning columns; wherein the length of the seal positioning columns is greater than the length of the seal mounting ribs to provide a positioning function, and the seal mounting ribs and the seal positioning columns are respectively provided at ends away from the sealing ring with hook structures that match the seal mounting holes to securely fix the sealing ring to the periphery of the airflow outlet.

Furthermore, wherein the seal mounting structures comprise a plurality of seal mounting ribs and a plurality of seal positioning columns; wherein the length of the seal positioning columns is greater than the length of the seal mounting ribs to provide a positioning function, and the seal mounting ribs and the seal positioning columns are respectively provided at ends away from the sealing ring with hook structures that match the seal mounting holes to securely fix the sealing ring to the periphery of the airflow outlet.

Furthermore, wherein the sealing ring comprises a seal body, with the seal mounting structures provided on one side of the seal body;

the sealing ring further comprises a bent structure formed on the other side of the seal body, and the cross-section of the bent structure has an inward-facing bend angle.

Furthermore, wherein the width of the side wall of the bent structure away from the seal body is greater than the width of the seal body;

the sealing ring is made of flexible material and is configured to fit completely against the corresponding air outlet when the aging drawer is pushed into the cabinet.

Furthermore, wherein the middle part of the rear wall of the aging drawer has a recess formed inwardly into the aging chamber, with a return air baffle at the front end of the recess, and two extension surfaces extending obliquely from both sides of the return air baffle to the rear wall, with the inclination direction expanding outward from front to back, and the two extension surfaces being respectively provided with the air outlets; and the circulation fan is located at the rear of the recess to direct airflow through the air outlets on the two extension surfaces into the aging chamber.

Furthermore, wherein the circulation fan is configured as a centrifugal fan, the circulation fan comprising a casing and a centrifugal impeller provided inside the casing;

the lateral sides of the casing are respectively provided with the airflow outlets.

Furthermore, wherein the casing forms seal stopper ribs projecting outwardly at the periphery of each airflow outlet, and the seal stopper ribs are located outside the sealing rings to prevent the sealing rings from moving backward when the aging drawer is pushed into the cabinet.

Furthermore, wherein the aging device further comprising:

at least one air duct plate, provided inside the aging drawer, defining the aging chamber on the inner side of the air duct plate and at least one air supply duct surrounding at least part of the periphery of the aging chamber on the outer side; wherein the aging chamber is connected to the air supply duct through a plurality of air supply openings arranged along the airflow direction within the air supply duct; and the air supply duct is connected to the circulation fan through the at least one air outlet.

Furthermore, wherein there are two air duct plates, each defining an air supply duct with the aging drawer; and the two air duct plates are symmetrically arranged on the lateral sides of the aging drawer to form two air supply ducts surrounding the lateral and rear sides of the aging chamber;

there are two air outlets, symmetrically distributed on both sides of the return air inlet and respectively connected to the two air supply ducts.

According to the second aspect of the present application, a refrigerating and freezing apparatus is also provided, comprising:

a cabinet defining a storage chamber for storing items; and the aging device according to any one of embodiments above, for aging items to be aged therein, the aging device being provided in the storage chamber.

The aging device of the present application is applied in refrigerating and freezing apparatus, effectively utilizing the low-temperature and high-humidity environment within the refrigerating and freezing apparatus to age the items to be aged, without the need for a dedicated temperature control device and humidity control device, simplifying the structure of the aging device and reducing its cost. Furthermore, the aging device of the present application is provided with at least one sealing ring between the circulation fan and the aging drawer, with each sealing ring annularly arranged around the periphery of an airflow outlet. Each sealing ring is configured to fit against the corresponding air outlet when the aging drawer is pushed into the cabinet, achieving a sealed connection between the air outlet and the airflow outlet of the circulation fan. This ensures that the internal circulation air duct of the aging device is tightly sealed, allowing all the airflow blown by the circulation fan to enter the aging chamber through the air outlets, thereby avoiding low aging efficiency or even aging failure due to low airflow circulation efficiency within the aging chamber.

Furthermore, a plurality of seal mounting holes are spaced around the periphery of each airflow outlet, and each sealing ring comprises a seal body and a plurality of seal mounting structures spaced on one side of the seal body. The seal mounting structures are locked and fitted with the seal mounting holes. This optimizes and defines the structure of the sealing rings provided in the aging device, achieving easier and more reliable mounting of the sealing rings between the circulation fan and the aging drawer, thereby further improving the sealing performance between the air outlet of the aging drawer and the airflow outlet of the circulation fan.

From the detailed description of specific embodiments of the present application in conjunction with the accompanying drawings, those skilled in the art will become more apparent of the above and other objectives, advantages, and features of the present application.

As used herein, except where the context clearly requires otherwise, the term "comprise" and variations of the term, such as "comprising", "comprises" and "comprised", are not intended to exclude further features, components, integers or steps.

BRIEF DESCRIPTION OF DRAWINGS

The following detailed description of some specific embodiments of the present application will be made by referring to the accompanying drawings, which are exemplary and non-limiting. Identical reference numerals in the drawings denote identical or similar components or parts. Those skilled in the art should understand that these drawings are not necessarily drawn to scale. In the drawings.

DETAILED DESCRIPTION OF EMBODIMENTS

To solve at least one of the above-mentioned technical problems, the present application firstly provides an aging device for refrigerating and freezing apparatus, used for aging items to be aged therein. In other words, the aging device of the present application is applied in refrigerating and freezing apparatus, effectively utilizing the low-temperature and high-humidity environment within the refrigerating and freezing apparatus to age the items to be aged, without the need for a dedicated temperature control device and humidity control device, simplifying the structure and reducing the cost of the aging device.

Figure 1:
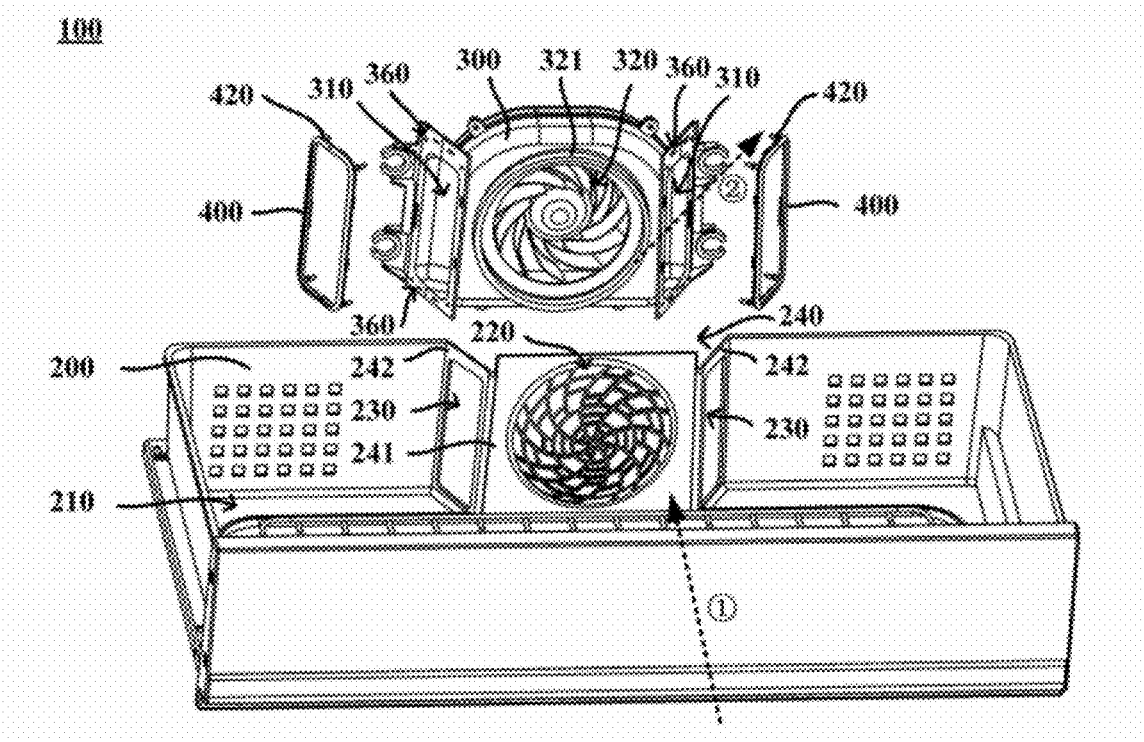
FIG. 1 is an exploded schematic diagram of an aging device according to an embodiment of the present application.

FIG. 1 is an exploded diagram of an aging device according to one embodiment of the present application, showing the aging drawer and the circulation fan in a separated state to reveal the interior. As shown in FIG. 1, the aging device 100 for refrigerating and freezing apparatus of the present application includes an aging drawer 200, a circulation fan 300, and at least one sealing ring 400.

The aging drawer 200 is retractably provided in a cabinet of the refrigerating and freezing apparatus, the interior of the aging drawer 200 is defined an aging chamber 210 for containing the items to be aged. The rear wall of the aging drawer 200 is provided with a return air inlet 220 and at least one air outlet 230. The circulation fan 300 is provided with at least one airflow outlet 310 and is configured such that, when the aging drawer 200 is pushed into the cabinet, each airflow outlet 310 faces one of the at least one air outlet 230, directing airflow through at least one air outlet 230 into the aging chamber 210 and then out through the return air inlet 220. Specifically, the circulation fan 300 is provided at the rear of the aging drawer 200, with the number of airflow outlets 310 is the same as the number of air outlets 230. When the aging drawer 200 is pushed into the cabinet, the airflow outlets 310 are aligned with the air outlets 230 one-to-one. a plurality of seal mounting holes 360 are spaced around the periphery of each airflow outlet 310. Each sealing ring 400 is annularly arranged around the periphery of a corresponding airflow outlet 310 and is configured to fit against the corresponding air outlet 230 when the aging drawer 200 is pushed into the cabinet, thereby achieving a sealed connection between each airflow outlet 310 and the corresponding air outlet 230. Specifically, a plurality of seal mounting structures 420 are spaced on one side of each sealing ring 400 and locked and fitted with the seal mounting holes 360, allowing the sealing ring 400 to be quickly and securely mounted on the airflow outlet 310 of the circulation fan 300 during the installation of the aging device.

In other words, the aging drawer 200 and the circulation fan 300 of the present application can be separately provided in the cabinet of the refrigerating and freezing apparatus. The aging drawer 200 can be pulled out and pushed in. When the aging drawer 200 is pushed inwards, the aging drawer 200 eventually contacts the sealing ring 400, causing the air outlets 230 provided on the aging drawer 200 to connect and seal with the airflow outlets 310 provided on the circulation fan 300 one by one, thereby completing the sealing of the internal circulation air duct of the aging device 100. For example, the circulation fan 300 is fixedly installed at the rear of the cabinet, while the aging drawer 200 is retractably installed in the cabinet. When the aging drawer 200 is pulled out, the aging drawer 200 separates from the circulation fan 300, breaking the internal circulation air path within the aging chamber 210; when the aging drawer 200 is pushed in, the air outlets 230 align with the airflow outlets 310 of the circulation fan 300 and press the sealing ring 400 to achieve a sealed connection, thereby preventing air leakage in the internal circulation air path of the aging chamber 210. This ensures that all the airflow blown by the circulation fan 300 enters the aging chamber 210 through the air outlets 230, avoiding issues of low aging efficiency or even aging failure caused by low airflow circulation efficiency within the aging chamber 210.

Specifically, as shown in FIG. 1, the middle part of the rear wall of the aging drawer 200 has a recess 240 formed inwardly into the aging chamber 210, with a return air baffle 241 at the front end of the recess 240. The middle part of the return air baffle 241 is provided with a return air inlet 220. Two extension surfaces 242 extend obliquely from both sides of the return air baffle 241 to the rear wall of the aging drawer 200, expanding outward from front to back, with air outlets 230 formed on the two extension surfaces 242. In some specific embodiments, the horizontal cross-section of the recess 240 is trapezoidal, narrower at the front and wider at the back, with the two extension surfaces 242 forming an oblique angle with the pushing direction of the aging drawer 200. The circulation fan 300 is located behind the recess 240, with two airflow outlets 310 and an airflow inlet 320 provided on the circulation fan 300. The airflow inlet 320 is aligned with the return air inlet 220, and the two airflow outlets 310 are respectively aligned with the two air outlets 230. When the aging drawer 200 is pushed into the cabinet, the two airflow outlets 310 of the circulation fan 300 align with the two air outlets 230, directing airflow through the air outlets 230 on the two extension surfaces 242 into the aging chamber 210. The airflow then circulates through the entire aging chamber 210 and returns to the circulation fan 300 through the return air inlet 220, thereby forming the internal circulation air path of the aging device.

In other words, the middle part of the rear wall of the aging drawer 200 of the present application has a recess 240 formed inwardly into the space, serving as a receiving space for accommodating the circulation fan 300. This makes the structure of the aging device 100 more compact and smaller in volume, thereby avoiding occupying too much space inside the refrigerating and freezing apparatus. More importantly, on one hand, the rear wall of the aging drawer 200 is provided with two air outlets 230 on both sides of the return air inlet 220, both forming an oblique angle with the pulling direction of the aging drawer 200. When the aging drawer 200 is pushed into the cabinet, the circulation fan 300 directs airflow through the two air outlets 230 from the lateral sides into the aging chamber 210. The airflow circulates through the entire aging chamber 210 and then returns to the circulation fan 300 through the return air inlet 220, thereby improving the uniformity and efficiency of the airflow. On the other hand, the contact surface between the aging drawer 200 and the sealing ring 400 forms an oblique angle with the pulling direction of the aging drawer 200, enabling the air outlets 230 of the aging drawer 200 to be easily and reliably sealed with the airflow outlets 310 of the circulation fan 300.

In the above embodiments, an outer peripheral side of each airflow outlet 310 is fixedly installed with a sealing ring 400, sealing the gap between the edges of the airflow outlet 310 and the corresponding air outlet 230 when the aging drawer 200 is pushed into the cabinet. It should be noted that the shape of the airflow outlets 310 and the air outlets 230 are substantially consistent, and the areas of the airflow outlets 310 and the air outlets 230 are also substantially the same. The shape of the inner edge of the sealing ring 400 is consistent with the shape of the airflow outlet 310, allowing the sealing ring 400 to fit around the periphery of the airflow outlet 310. For example, both the airflow outlets 310 and the air outlets 230 can be rectangular openings with consistent shapes and areas. The inner edge of the sealing ring 400 is also a rectangle with a consistent shape and area, achieving a sealed connection between the airflow outlet 310 and the air outlet 230 using the sealing ring 400, while avoiding obstruction of the airflow blown by the circulation fan 300 by the sealing ring 400, thereby further ensuring the efficiency of the airflow circulation.

In some optional embodiments, as shown in FIG. 1, the edges of the airflow outlet 310 and the air outlet 230 are both planar. When the aging drawer 200 is fully pushed into the cabinet, the airflow outlet 310 and the air outlet 230 are aligned, with the planes of the edges of the airflow outlet 310 and the air outlet 230 forming mating sealing surfaces that are planar. At this time, the flexible sealing ring 400 with planar sealing surfaces can achieve a sealed connection. Even if there is a slight lateral deviation when the aging drawer 200 is fully pushed into the cabinet, the flexible sealing ring 400 can undergo some deformation under pression to achieve a sealed connection between the airflow outlet 310 and the air outlet 230.

Of course, in other optional embodiments, the mating sealing surfaces between each set of airflow outlets and air outlets can also be curved surfaces or other irregular shapes. The specific form of the sealing surfaces is not limited by the present application, as long as the flexible sealing ring 400 with the corresponding shape can achieve a sealed connection between the airflow outlet and the air outlet. Such solutions should fall within the protection scope of the present application.

In some embodiments, as shown in FIG. 1, the periphery of the airflow inlet 320 of the circulation fan 300 is provided with a sealing structure 321. The sealing structure 321 can be fixedly installed on the periphery of the airflow inlet 320 by means such as adhesive, and is configured to fit against the return air inlet 220 when the aging drawer 200 is pushed into the cabinet, thereby completing the sealed connection between the airflow inlet 320 and the return air inlet 220. This further improves the sealing performance of the internal circulation air path.

Figure 2:
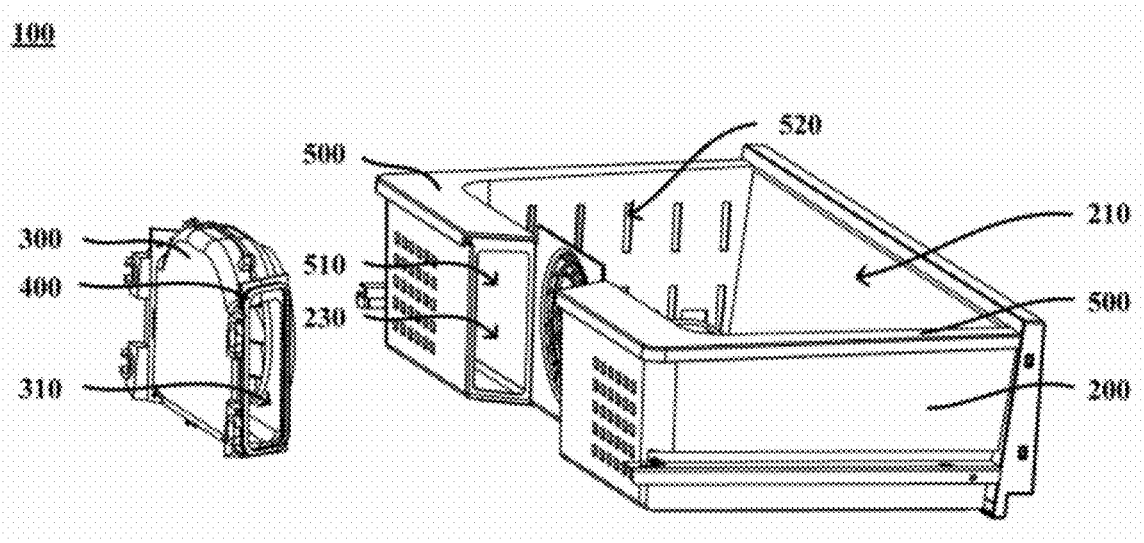
FIG. 2 is an exploded schematic diagram of an aging device according to another embodiment of the present application.

FIG. 2 is an exploded diagram of the aging device 100 according to another embodiment of the present application. As shown in FIG. 2, the aging device 100 of the present application further includes at least one air duct plate 500.

At least one air duct plate 500 is provided inside the aging drawer 200, an aging chamber 210 and at least one air supply duct 510 are defined between the aging drawer 200 and the at least one air duct plate 500, the aging chamber 210 is provided on the inner side of the air duct plate 500, the at least one air supply duct 510 is surrounding at least part of the periphery of the aging chamber 210. The aging chamber 210 is connected to the air supply duct 510 through a plurality of air supply openings 520 arranged along the airflow direction within the air supply duct 510, the a plurality of air supply openings 520 are provided on the air supply duct 510. The air supply duct 510 is connected to the circulation fan 300 through at least one air outlet 230. In other words, the aging device 100 of the present application has a two-layer structure including of the aging drawer 200 and the air duct plate 500, with the aging chamber 210 defined on the inner side of the air duct plate 500 and the air supply duct 510 defined between the air duct plate 500 and the aging drawer 200. When the aging drawer 200 is pushed into the cabinet, the air blown by the circulation fan 300 enters the corresponding air duct plate 500 through the air outlet 230, flows through the air supply duct 510 between the air duct plate 500 and the aging drawer 200, and is sent to the aging chamber 210 through the air supply openings 520 arranged on the circumferential side wall of the air duct plate 500, thereby further improving the uniformity of the airflow.

Specifically, the air supply openings 520 are arranged sparsely at the top and densely at the bottom on the circumferential side wall of the air duct plate 500. That is, the arrangement of the air supply openings 520 is sparser at the upper part and denser at the lower part, so that more airflow from the air supply duct 510 flows into the lower part of the aging chamber 210, blowing towards the bottom of the items to be aged, inhibiting the growth and reproduction of microorganisms, thereby preventing the items to be aged from easily decaying and deteriorating due to high humidity at the bottom.

In some embodiments, the aging device 100 of the present application includes two air duct plates 500, that is, the number of air duct plates 500 is two, and the two air duct plates 500 respectively define an air supply duct 510 with the aging drawer 200. The two air duct plates 500 are symmetrically arranged on the lateral sides of the aging drawer 200, so that the two air supply ducts 510 surround the lateral and rear sides of the aging chamber 210.

In this embodiment, the number of air outlets 230 is two, symmetrically distributed on both sides of the return air inlet 220, and respectively connected to the two air supply ducts 510. The number of airflow outlets 310 is also two, symmetrically distributed on both sides of the circulation fan 300, and the two air outlets 230 are respectively aligned with the two airflow outlets 310. The number of sealing rings 400 is two, with each sealing ring 400 installed on the periphery of an airflow outlet 310, and the two sealing rings 400 are symmetrically distributed on both sides of the circulation fan 300. When the aging drawer 200 is pushed into the cabinet, the circulation fan 300 directs airflow through the two air outlets 230 into the aging chamber 210 from the lateral sides, circulates through the entire aging chamber 210, and returns to the circulation fan 300 through the return air inlet 220, thereby improving the uniformity and efficiency of the airflow.

Figure 3:
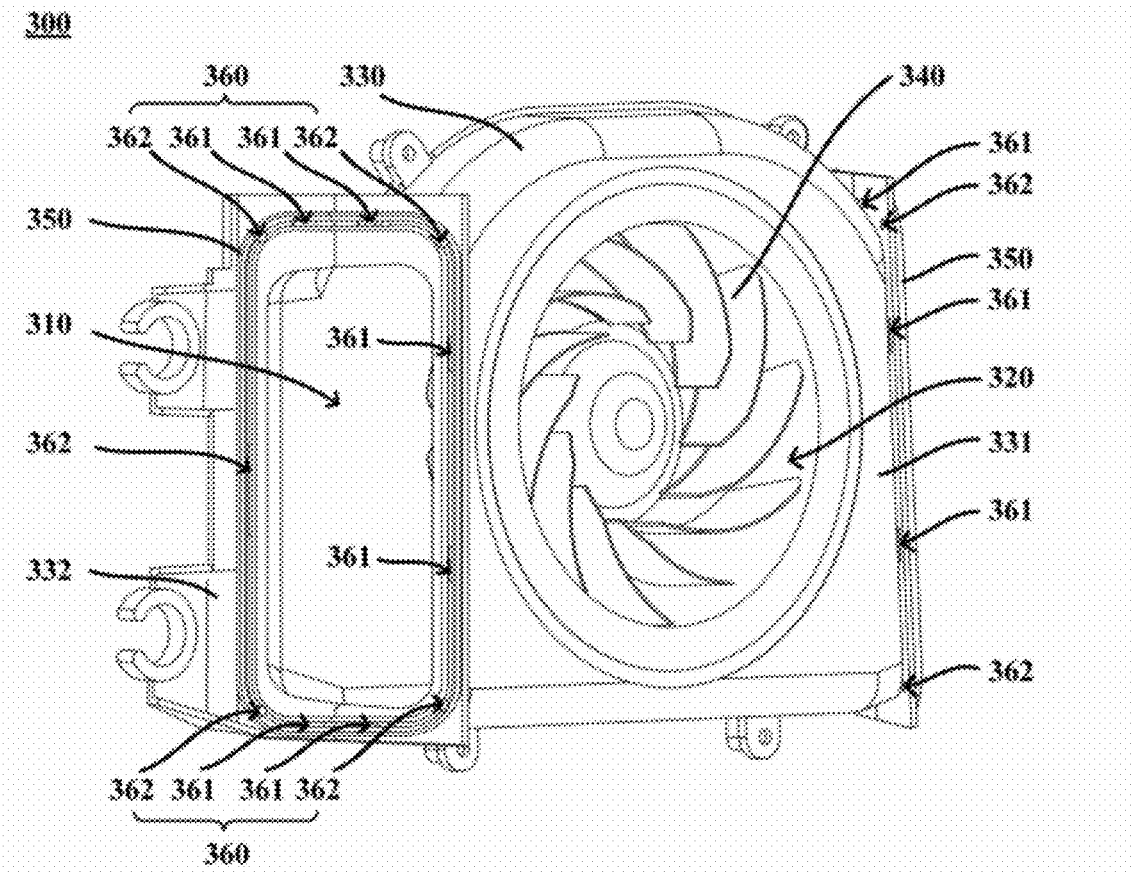
FIG. 3 is a schematic diagram of a circulation fan of the aging device according to an embodiment of the present application.

FIG. 3 is a schematic diagram of the circulation fan 300 of the aging device 100 according to an embodiment of the present application. As shown in FIG. 3, the circulation fan 300 of the present application is a centrifugal fan and includes a casing 330 and a centrifugal impeller 340 provided inside the casing 330. The lateral sides of the casing 330 are respectively provided with an airflow outlet 310, and each airflow outlet 310 is configured to align with an air outlet 230 when the aging drawer 200 is pushed into the casing. The middle front side of the casing 330 is provided with an airflow inlet 320, which is configured to align with the return air inlet 220 when the aging drawer 200 is pushed into the cabinet. When the circulation fan operates, the circulation fan directs airflow entering the casing 330 from the airflow inlet 320 to be expelled from the lateral sides through the airflow outlets 310.

In some optional embodiments, as shown in FIG. 3, the casing 330 includes a front fan cover 331 and a rear fan cover 332. When installing the aging device 100, the front fan cover 331 and the rear fan cover 332 are first installed, with the openings on the lateral sides of the front fan cover 331 and the rear fan cover 332 forming two airflow outlets 310. Then, the two sealing rings 400 are respectively installed and fixed around the periphery of the airflow outlets 310. The front fan cover 331 and the rear fan cover 332 can be fixed together using four screws or other methods, and the present application does not limit the installation method of the casing 330. Additionally, the airflow outlets 310 can also be provided on only one of the front fan cover 331 and the rear fan cover 332, as long as the airflow outlets 310 have a sufficiently large area, and the present application does not limit this configuration either.

In other optional embodiments, the casing 330 can also include a fan upper cover and a fan base (not shown in the figure), which are assembled together to form the casing 330. The fan upper cover and the fan base are respectively provided with openings on their lateral sides. After the fan upper cover and the fan base are installed, the openings are aligned to form the airflow outlets 310. Alternatively, the airflow outlets 310 can also be provided on only one of the front fan cover 331 or the rear fan cover 332, as long as the airflow outlets 310 have a sufficiently large area. The present application does not limit this configuration. After the casing 330 is assembled, the sealing rings 400 are fixedly installed at the positions around the airflow outlets 310 on the casing 330. Of course, in other embodiments, the casing 330 can also be assembled by other methods. The present application does not limit the assembly method, as long as the casing 330 has at least one airflow outlet 310, and each airflow outlet 310 has a sealing ring 400 fixedly installed around the periphery.

In some embodiments, as shown in FIG. 3, the casing 330 has seal stopper ribs 350 projecting outwardly around the periphery of each airflow outlet 310. The seal stopper ribs 350 are located outside a plurality of seal mounting holes 360. When the seal mounting structures 420 of the sealing ring 400 are inserted into the seal mounting holes 360 by locking, the sealing ring 400 is positioned inside the seal stopper ribs 350. This allows the seal stopper ribs 350 to provide support and prevent the sealing ring 400 from moving backward when the aging drawer 200 is pushed into the cabinet. In other words, after the sealing ring 400 is installed around the periphery of the airflow outlet 310, the seal stopper ribs 350 can effectively hold the sealing ring 400 when the aging drawer 200 is fully pushed into the cabinet. Specifically, when the aging drawer 200 is pushed inward and contacts the sealing ring 400, the inner surface of the seal stopper ribs 350 provides support to hold the sealing ring 400, counteracting the backward force from the aging drawer 200. This prevents the sealing ring 400 from moving backward due to repeated pulling and pushing of the aging drawer 200, ensuring the sealing function of the sealing ring 400. It should be noted that the seal stopper ribs 350 around each airflow outlet 310 can be a continuous annular step surface or composed of a plurality of separate small step surfaces arranged at intervals. The present application does not limit this configuration as long as it supports the rear edge of the sealing ring 400 and prevents the sealing ring 400 from moving backward when the aging drawer 200 is pushed inward.

To further illustrate the potential movement direction of the sealing ring 400 in the above-mentioned embodiments, refer to the rays ① and ② marked in FIG. 1. Ray ① indicates the direction in which the aging drawer 200 is pushed, and ray ② indicates the potential movement direction of the sealing ring 400 adhered to the casing 330. The reason for this movement is that when the aging drawer 200 is pushed inward, it presses the sealing ring 400, causing the sealing ring 400 to move backward. This movement can result in a failure of the seal at this point, thereby affecting the normal operation of the entire aging system.

Figure 4:
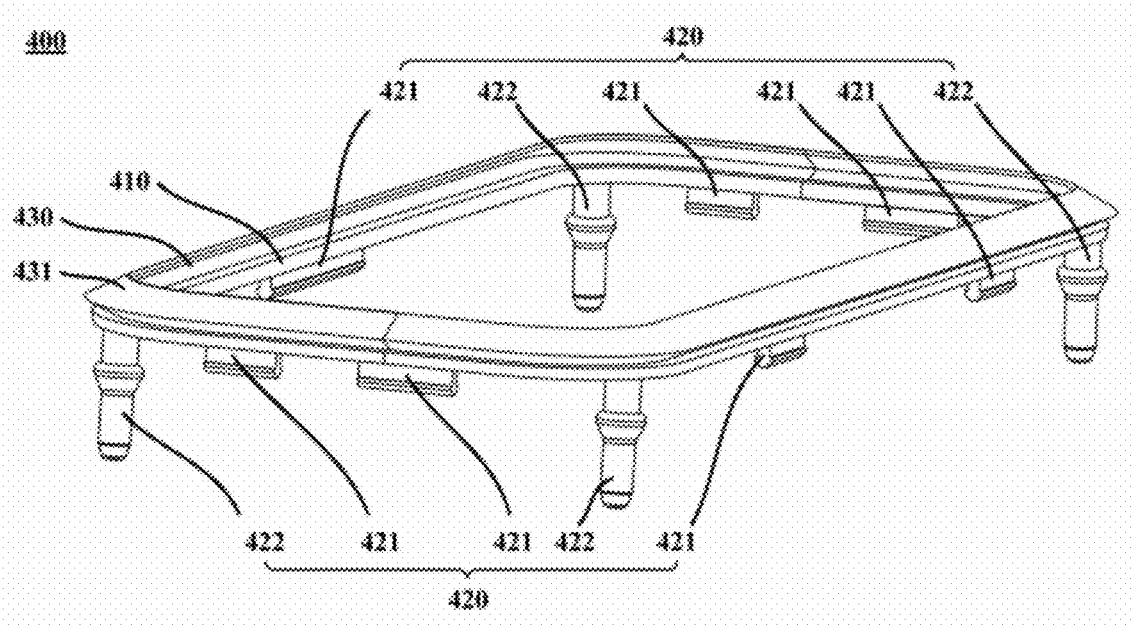
FIG. 4 is a schematic diagram of a sealing ring of the aging device according to an embodiment of the present application.

FIG. 4 is a schematic diagram of the sealing ring of the aging device according to an embodiment of the present application. As shown in FIGS. 3 and 4, each sealing ring 400 of the present application includes a seal body 410 and a plurality of seal mounting structures 420 spaced on one side of the seal body 410. Each seal mounting structure 420 corresponds to a seal mounting hole 360 spaced around the periphery of an airflow outlet 310. Each seal mounting structure 420 is locked with a seal mounting hole 360, allowing the sealing ring 400 to be quickly and securely mounted on the periphery of the airflow outlet 310 of the circulation fan 300 during the installation of the aging device 100.

In the above embodiments, as shown in FIG. 4, the seal mounting structures 420 include a plurality of seal mounting ribs 421 and a plurality of seal positioning columns 422. Each seal mounting structure 420 is provided on one side of the seal body 410 in the same direction as the installation direction of the sealing ring 400. The length of the seal positioning columns 422 is greater than the length of the seal mounting ribs 421 to provide a positioning function. In other words, during the installation of the sealing ring 400, each seal positioning column 422 is first inserted into the corresponding seal mounting hole 360 according to the installation direction of the sealing ring 400 to determine the installation position of the sealing ring 400. Then, as the insertion continues, each seal mounting rib 421 is aligned with the corresponding seal mounting hole 360 and smoothly inserted into the respective seal mounting hole 360, completing the insertion of the sealing ring 400. In some specific embodiments, the seal mounting ribs 421 are strip-shaped. Correspondingly, as shown in FIG. 3, the seal mounting holes 360 include a plurality of strip holes 361 and a plurality of round holes 362 that match the a plurality of seal mounting ribs 421 and the a plurality of seal positioning columns 422, respectively. During the installation of the sealing ring 400, the seal mounting ribs 421 at the corresponding positions are locked with the strip holes 361, and the seal positioning columns 422 at the corresponding positions are locked with the round holes 362.

In this embodiment, the number of seal mounting ribs 421 and seal positioning columns 422 can be set according to the shape and size of the sealing ring 400, as long as they ensure that the sealing ring 400 is securely mounted around the periphery of the airflow outlet 310 and provide sufficient support to prevent the sealing ring 400 from moving backward. In some specific embodiments, more than two seal positioning columns 422 are evenly spaced on one side surface of the seal body 410, with at least one seal mounting rib 421 spaced between every two adjacent seal positioning columns 422. For example, if the sealing ring 400 is rectangular, one seal positioning column 422 is provided at each of the four corners on one side surface of the seal body 410. Additionally, two seal mounting ribs 421 are symmetrically provided on the upper and lower sides, two seal mounting ribs 421 are provided on the lateral front side, and one seal mounting ribs 421 are provided on the lateral rear side. This arrangement ensures that the seal mounting structures 420 are distributed in all directions on one side surface of the seal body 410, allowing the sealing ring 400 to be securely inserted into the circulation fan 300 and providing sufficient support to prevent the sealing ring 400 from moving during the pulling and pushing process of the aging drawer 200.

In this embodiment, the seal mounting ribs 421 and seal positioning columns 422 are also provided with hook structures that engage with the seal mounting holes 360 (not shown in the figure), ensuring that the seal body 410 is securely fixed around the periphery of the airflow outlet 310, preventing the sealing ring 400 from falling off during the pulling and pushing process of the aging drawer 200. The hook structure includes a guide surface, which is set away from the seal body 410 (not shown in the figure), and an anti-detachment surface, which faces the seal body 410 (not shown in the figure). The guide surface is used to guide the seal mounting ribs 421 or seal positioning columns 422 into the seal mounting holes 360 in the installation direction of the sealing ring 400. The anti-detachment surface is set at the rear of the guide surface and is used to prevent the seal mounting ribs 421 or seal positioning columns 422 from detaching after they are fully inserted into the seal mounting holes 360. In some specific embodiments, the top of the seal mounting ribs 421 forms two guide surfaces symmetrically arranged on both sides of the seal mounting rib body. These two guide surfaces extend obliquely outward from both sides of the top wall of the body, making the top structure of the hook structure of the seal mounting ribs 421 narrow at the front and wide at the back along the installation direction of the sealing ring 400. Additionally, the guide surface of the seal positioning columns 422 is conical, surrounding the middle of the seal positioning column 422 body, with the outer diameter of the guide surface gradually increasing from front to back along the installation direction of the sealing ring 400.

In some embodiments, as shown in FIG. 4, the sealing ring 400 further includes a bent structure 430 formed on the other side of the seal body 410. The seal body 410 and the bent structure 430 are integrally formed and made of flexible material. The cross-section of the bent structure 430 has an inward-facing bend angle, allowing the flexible bent structure 430 to better fit tightly around the air outlet 230 from all directions, preventing airflow leakage. When the aging drawer 200 is pushed into the cabinet and begins to press the bent structure 430 of the sealing ring 400, the airflow blown from the airflow outlet 310 can blow onto the inner opening of the bent structure and return, entering the aging drawer 200 through the air outlet 230. Additionally, the width of the sidewall 431 of the bent structure 430 on the side away from the seal body 410 is greater than the width of the seal body 410. When the aging drawer 200 is pushed into the cabinet and begins to press the bent structure 430 of the sealing ring 400, this sidewall 431 contacts the edge of the air outlet 230. Increasing the width of the sidewall 431 enhances the contact area between the bent structure 430 and the edge of the air outlet 230, further improving the sealing effect. The sealing ring 400 of the present application, with the bent structure 430, increases the contact area between the sealing ring 400 and the air outlet 230, and enhances the deformation capacity of the sealing ring 400. This effectively ensures that the sealing ring 400 tightly fits with the air outlet 230 when the aging drawer 200 is pushed into the cabinet, minimizing the risk of airflow leakage from the circulation fan 300, reducing leakage risk, and improving safety.

Furthermore, the sealing ring 400 is made of flexible material, with the seal body 410 closely fitting against the casing 330 around the periphery of the airflow outlet 310. When the aging drawer 200 is pushed into the cabinet and begins to press the sealing ring 400, the bent structure 430 tightly contacts the edge of the corresponding air outlet 230, thereby achieving a sealed connection between the airflow outlet 310 and the corresponding air outlet 230. When the casing 330 is assembled by the front fan cover 331 and the rear fan cover 332, even if the contact surface between the fan covers 331 and 332 and the seal body 410 is slightly misaligned due to various reasons, due to the deformation of the seal body 410 and the insertion and then locking of the sealing ring 400 allow the inner surface of the seal body 410 to simultaneously adhere tightly to both the front fan cover 331 and the rear fan cover 332. The elasticity of the seal body 410 fills in the misalignment, ensuring that the inner surface of the seal body 410 closely fits the outer surface of the casing 330. Additionally, the sealing ring 400 is configured such that, after the aging drawer 200 is pushed into the cabinet, the sidewall 431 of the bent structure 430 on the side away from the seal body 410 fits completely against the corresponding air outlet 230. In other words, the sealing ring 400 utilizes the deformation of the bent structure 430, caused by the inward push of the aging drawer 200, to fill the gap between the sidewall 431 and the outer surface of the corresponding air outlet 230, thereby further improving the sealing effect.

Figure 5:
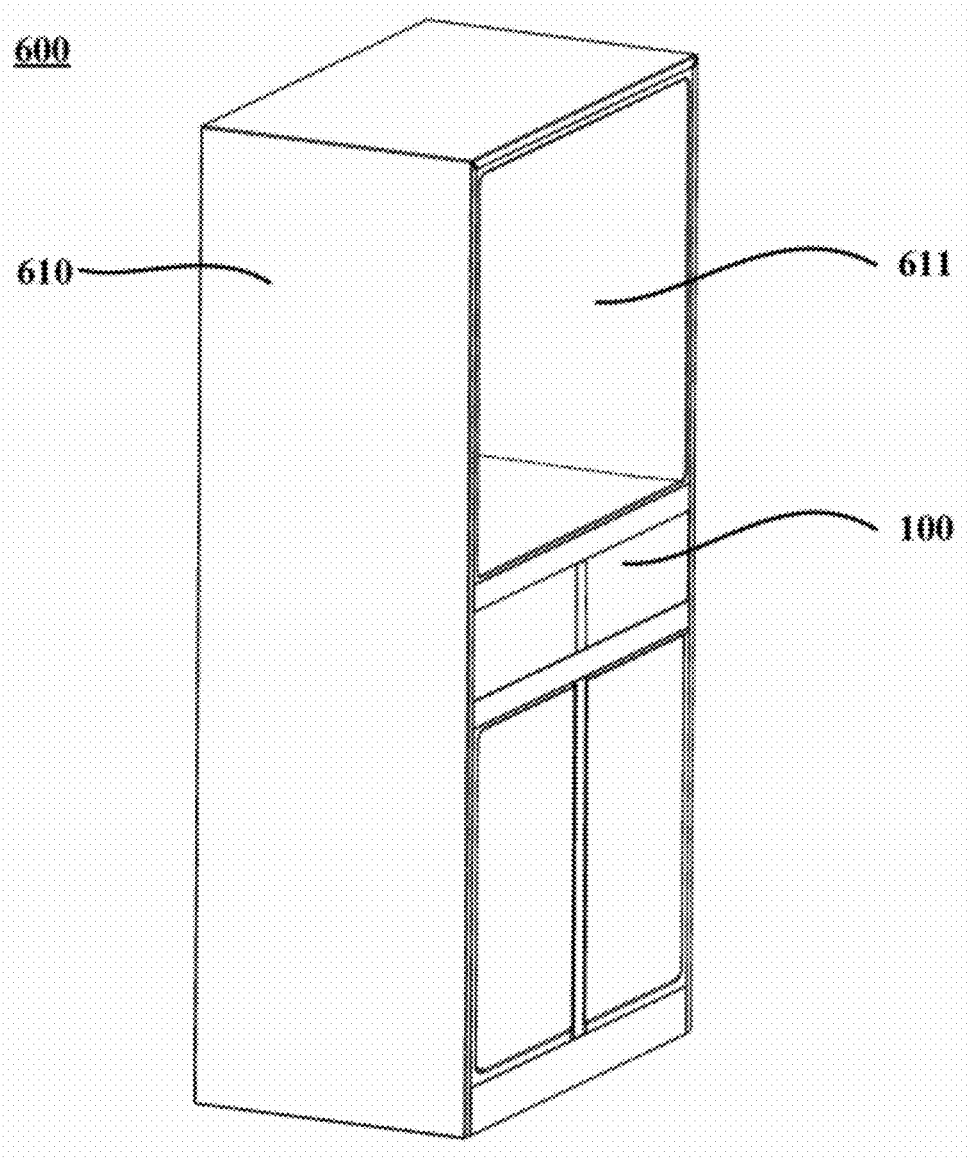
FIG. 5 is a schematic diagram of a refrigerating and freezing apparatus according to an embodiment of the present application.

According to the second aspect of the present application, the invention also provides a refrigerating and freezing apparatus. FIG. 5 is a schematic diagram of the refrigerating and freezing apparatus according to an embodiment of the present application. As shown in FIG. 5, the refrigerating and freezing apparatus 600 of the present application includes a cabinet 610 and the aging device 100 described in any of the aforementioned embodiments.

The cabinet 610 defines a storage chamber 611 for storing items. The aging device 100 is used for aging items to be aged therein and is provided in the storage chamber 611. The refrigerating and freezing apparatus 600 integrated with the aging device 100 not only has the traditional function of preserving items in a low-temperature environment but also has an aging function, enriching the functionality of the refrigerating and freezing apparatus 600.

In this embodiment, the interior of the cabinet 610 can form a plurality of storage chambers 611, such as a refrigeration chamber, a freezing chamber, a quick-cooling chamber, and a variable-temperature chamber.

In some optional embodiments, the aging device 100 can be disposed in a refrigeration chamber with a storage temperature range between 0 to 8° C., which is more suitable for the temperature requirements of the items to be aged. Additionally, the humidity in the refrigeration chamber is usually higher than the indoor environment, which is more suitable for the humidity requirements of the items to be aged. Even if the humidity inside the aging device 100 is not suitable, it can be easily adjusted through the airflow in the refrigeration chamber. Therefore, providing the aging device 100 in the refrigeration chamber can fully utilize the temperature and humidity conditions of the refrigeration chamber itself, thereby minimizing costs.

In other optional embodiments, the aging device 100 can also be independently refrigerated by the cooling duct within the refrigerating and freezing apparatus 600, using the cooling duct to deliver cooling airflow at a specified temperature, thereby regulating the temperature inside the aging device 100. For example, the temperature inside the aging device 100 can be controlled between 0-4° C. The present application does not limit the refrigeration method of the aging device, as long as it creates an environment suitable for dry aging food, allowing for homemade dry-aged food.

It should be understood by those skilled in the art that the refrigerating and freezing apparatus 600 of the present application can be a French-door refrigerator, with the aging device 100 being placed in one of the refrigeration chambers at the upper part.

In other embodiments, the refrigerating and freezing apparatus 600 is not limited to the refrigerator structure shown in FIG. 5. It can also be a double-door refrigerator, with the aging device 100 placed in the refrigeration chamber at the upper part.

In other embodiments, the refrigerating and freezing apparatus 600 is not limited to the refrigerator structure shown in FIG. 5. It can also be a three-door refrigerator, with the aging device 100 placed in the refrigeration chamber at the upper part.

In other embodiments, the refrigerating and freezing apparatus 600 is not limited to the refrigerator structure shown in FIG. 5. It can also be a side-by-side refrigerator, with the aging device 100 placed in a chamber with a refrigeration storage environment.

In other embodiments, the refrigerating and freezing apparatus 600 is not limited to the refrigerator structure shown in FIG. 5. It can also be a freezer, chest freezer, or other variously shaped refrigerating and freezing apparatus 600, with the aging device 100 placed in a space with a refrigeration storage environment.

It should also be understood by those skilled in the art that the terms "upper," "lower," "left," "right," "middle," "lateral," "front," "rear," "inner," "outer," and the like used in the description of the embodiments of the present application are based on the actual usage state of the aging device 100. These terms are merely for convenience in describing and understanding the technical solutions of the present application and are not meant to indicate or imply that the referred devices or elements must have specific orientations or be constructed and operated in specific orientations. Therefore, they should not be construed as limiting the present application.

Thus, it should be recognized by those skilled in the art that, although a plurality of exemplary embodiments of the present application have been shown and described in detail herein, many other variations or modifications consistent with the principles of the present application can still be determined or derived directly from the disclosed content without departing from the spirit and scope of the present application. Therefore, the scope of the present application should be understood and determined to cover all such other variations or modifications.

What is claimed is:

1. An aging device for refrigerating and freezing apparatus, configured for aging items to be aged therein, wherein the aging device comprising:

an aging drawer configured to be retractably provided in a cabinet of the refrigerating and freezing apparatus, an interior of the aging drawer defines an aging chamber for containing the items to be aged, a rear wall of the aging drawer being provided with a return air inlet and at least one rear wall air outlet;

a circulation fan is provided with at least one circulation fan airflow outlet and is configured such that, when the aging drawer is pushed into the cabinet, each circulation fan airflow outlet faces one of the at least one rear wall air outlet, directing airflow through the at least one rear wall air outlet into the aging chamber and then out through the return air inlet;

wherein a plurality of seal mounting holes are spaced around a periphery of each circulation fan airflow outlet;

the aging device further comprising:

at least one sealing ring, each sealing ring is annularly arranged around the periphery of a corresponding circulation fan airflow outlet and is configured to fit against the corresponding rear wall air outlet when the aging drawer is pushed into the cabinet, a plurality of seal mounting structures are spaced on one side of each sealing ring and are configured to lock and fit with the seal mounting holes.

2. The aging device according to claim 1, wherein the seal mounting structures comprise a plurality of seal mounting ribs and a plurality of seal positioning columns; wherein a length of the seal positioning columns is greater than the length of the seal mounting ribs to provide a positioning function, and the seal mounting ribs and the seal positioning columns are respectively provided at ends away from the sealing ring with hook structures that match the seal mounting holes to securely fix the sealing ring to the periphery of the circulation fan airflow outlet.

3. The aging device according to claim 2, wherein the middle part of the rear wall of the aging drawer has a recess formed inwardly into the aging chamber, with a return air baffle at the front end of the recess, and two extension surfaces extending obliquely from both sides of the return air baffle to the rear wall, with the inclination direction expanding outward from front to back, and the two extension surfaces being respectively provided with the rear wall air outlets; and the circulation fan is located at the rear of the recess to direct airflow through the rear wall air outlets on the two extension surfaces into the aging chamber.

4. The aging device according to claim 1, wherein the sealing ring comprises a seal body, with the seal mounting structures provided on one side of the seal body;

the sealing ring further comprises a bent structure formed on an other side of the seal body, and a cross-section of the bent structure has an inward-facing bend angle.

5. The aging device according to claim 4, wherein a width of the side wall of the bent structure away from the seal body is greater than a width of the seal body;

the sealing ring is made of flexible material and is configured to fit completely against the corresponding rear wall air outlet when the aging drawer is pushed into the cabinet.

6. The aging device according to claim 4, wherein the middle part of the rear wall of the aging drawer has a recess formed inwardly into the aging chamber, with a return air baffle at the front end of the recess, and two extension surfaces extending obliquely from both sides of the return air baffle to the rear wall, with the inclination direction expanding outward from front to back, and the two extension surfaces being respectively provided with the rear wall air outlets; and the circulation fan is located at the rear of the recess to direct airflow through the rear wall air outlets on the two extension surfaces into the aging chamber.

7. The aging device according to claim 2, wherein a middle part of the rear wall of the aging drawer has a recess formed inwardly into the aging chamber, with a return air baffle at a front end of the recess, and two extension surfaces extending obliquely from both sides of the return air baffle to the rear wall, with an inclination direction expanding outward from front to back, and the two extension surfaces being respectively provided with the rear wall air outlets; and the circulation fan is located at a rear of the recess to direct airflow through the rear wall air outlets on the two extension surfaces into the aging chamber.

8. The aging device according to claim 7, wherein the circulation fan is configured as a centrifugal fan, the circulation fan comprising a casing and a centrifugal impeller provided inside the casing;

lateral sides of the casing are respectively provided with the circulation fan airflow outlets.

9. The aging device according to claim 8, wherein the casing forms seal stopper ribs projecting outwardly at the periphery of each circulation fan airflow outlet, and the seal stopper ribs are located outside the sealing rings to prevent the sealing rings from moving backward when the aging drawer is pushed into the cabinet.

10. The aging device according to claim 1, wherein the aging device further comprising:

at least one air duct plate, provided inside the aging drawer, defining the aging chamber on an inner side of the air duct plate and at least one air supply duct surrounding at least part of a periphery of the aging chamber on an outer side; wherein the aging chamber is connected to the air supply duct through a plurality of air supply openings arranged along an airflow direction within the air supply duct; and the air supply duct is connected to the circulation fan through the at least one rear wall air outlet.

11. The aging device according to claim 10, wherein there are two air duct plates, each defining an air supply duct with the aging drawer; and the two air duct plates are symmetrically arranged on lateral sides of the aging drawer to form two air supply ducts surrounding lateral sides and rear sides of the aging chamber;

wherein the at least one rear wall air outlet comprises two rear wall air outlets, symmetrically distributed on both sides of the return air inlet and respectively connected to the two air supply ducts.

12. A refrigerating and freezing apparatus, comprising:

a cabinet defining a storage chamber for storing items; and an aging device for aging items to be aged therein, the aging device being provided in the storage chamber, wherein the aging device comprising:

an aging drawer configured to be retractably provided in a cabinet of the refrigerating and freezing apparatus, an interior of the aging drawer defines an aging chamber for containing the items to be aged, a rear wall of the aging drawer being provided with a return air inlet and at least one rear wall air outlet;

a circulation fan is provided with at least one circulation fan airflow outlet and is configured such that, when the aging drawer is pushed into the cabinet, each circulation fan airflow outlet faces one of the at least one rear wall air outlet, directing airflow through the at least one rear wall air outlet into the aging chamber and then out through the return air inlet, wherein a plurality of seal mounting holes are spaced around a periphery of each circulation fan airflow outlet;

the aging device further comprising:

at least one sealing ring, each sealing ring is annularly arranged around the periphery of a corresponding circulation fan airflow outlet and is configured to fit against the corresponding rear wall air outlet when the aging drawer is pushed into the cabinet, a plurality of seal mounting structures are spaced on one side of each sealing ring and are configured to lock and fit with the seal mounting holes.

13. The aging device according to claim 12, wherein the seal mounting structures comprise a plurality of seal mounting ribs and a plurality of seal positioning columns; wherein a length of the seal positioning columns is greater than a length of the seal mounting ribs to provide a positioning function, and the seal mounting ribs and the seal positioning columns are respectively provided at ends away from the sealing ring with hook structures that match the seal mounting holes to securely fix the sealing ring to the periphery of the circulation fan airflow outlet.

14. The aging device according to claim 12, wherein the sealing ring comprises a seal body, with the seal mounting structures provided on one side of the seal body;

the sealing ring further comprises a bent structure formed on an other side of the seal body, and a cross-section of the bent structure has an inward-facing bend angle.

15. The aging device according to claim 12, wherein a width of the side wall of the bent structure away from the seal body is greater than a width of the seal body;

the sealing ring is made of flexible material and is configured to fit completely against the corresponding rear wall air outlet when the aging drawer is pushed into the cabinet.

16. The aging device according to claim 12, wherein a middle part of the rear wall of the aging drawer has a recess formed inwardly into the aging chamber, with a return air baffle at a front end of the recess, and two extension surfaces extending obliquely from both sides of the return air baffle to the rear wall, with an inclination direction expanding outward from front to back, and the two extension surfaces being respectively provided with the rear wall air outlets; and the circulation fan is located at a rear of the recess to direct airflow through the rear wall air outlets on the two extension surfaces into the aging chamber.

17. The aging device according to claim 16, wherein the circulation fan is configured as a centrifugal fan, the circulation fan comprising a casing and a centrifugal impeller provided inside the casing;

lateral sides of the casing are respectively provided with the circulation fan airflow outlets;

wherein the casing forms seal stopper ribs projecting outwardly at the periphery of each circulation fan airflow outlet, and the seal stopper ribs are located outside the sealing rings to prevent the sealing rings from moving backward when the aging drawer is pushed into the cabinet.

18. The aging device according to claim 12, wherein the aging device further comprising:

at least one air duct plate, provided inside the aging drawer, defining the aging chamber on an inner side of the air duct plate and at least one air supply duct surrounding at least part of a periphery of the aging chamber on an outer side; wherein the aging chamber is connected to the air supply duct through a plurality of air supply openings arranged along an airflow direction within the air supply duct; and the air supply duct is connected to the circulation fan through the at least one rear wall air outlet.

* * * * *